US010828795B2

(12) United States Patent
Nabity

(10) Patent No.: US 10,828,795 B2
(45) Date of Patent: Nov. 10, 2020

(54) MULTI-DIE CUT WITH COMMON AXIS

(71) Applicant: TEK INDUSTRIES, INC., Omaha, NE (US)

(72) Inventor: Stephen Nabity, Elkhorn, NE (US)

(73) Assignee: TEK Industries, Inc., Omaha, NE (US)

( * ) Notice: Subject to any disclaimer, the term of this patent is extended or adjusted under 35 U.S.C. 154(b) by 63 days.

(21) Appl. No.: 14/759,403

(22) PCT Filed: Jan. 8, 2014

(86) PCT No.: PCT/US2014/010597
§ 371 (c)(1),
(2) Date: Jul. 6, 2015

(87) PCT Pub. No.: WO2014/110079
PCT Pub. Date: Jul. 17, 2014

(65) Prior Publication Data

US 2015/0352741 A1 Dec. 10, 2015

Related U.S. Application Data

(60) Provisional application No. 61/750,064, filed on Jan. 8, 2013.

(51) Int. Cl.
*B26F 1/44* (2006.01)
*B26D 1/00* (2006.01)

(52) U.S. Cl.
CPC ..... *B26F 1/44* (2013.01); *B26D 1/0006* (2013.01); *B26D 2001/0033* (2013.01); *Y10T 83/9476* (2015.04)

(58) Field of Classification Search
CPC ..... B26D 5/10; B26D 1/0006; B26D 2001/0033; B26F 1/44; B26F 2001/4463; B26F 2001/4481; Y10T 83/8702; Y10T 83/8704; Y10T 83/9476
See application file for complete search history.

(56) References Cited

U.S. PATENT DOCUMENTS 2,703,023 A * 3/1955 Sarno ..... B21D 37/205 76/107.8
2,821,871 A * 2/1958 Sarno ..... B21D 37/205 76/107.8
4,052,886 A * 10/1977 Buick ..... B26F 1/44 493/468

(Continued)

FOREIGN PATENT DOCUMENTS

EP 155665 A2 * 9/1985
FR 461921 A * 1/1914 ..... B26D 7/20
GB 1437341 A * 5/1976 ..... B26F 1/44

OTHER PUBLICATIONS

English Translation of FR461921.*

(Continued)

*Primary Examiner* — Jennifer B Swinney
(74) *Attorney, Agent, or Firm* — Milligan PC LLO

(57) ABSTRACT

A die includes a blade having an edge defining a shape for patterning a sheet of material. The die also includes a cushion surrounding the blade, where the blade edge is positioned within the cushion. The die also includes a support for holding the cutting blade in position and supporting the cushion. The die is configured to be at least partially surrounded by another die.

7 Claims, 4 Drawing Sheets

(56) References Cited

U.S. PATENT DOCUMENTS

| | | | | |
|---|---|---|---|---|
| 4,694,719 | A * | 9/1987 | Levene | B26D 7/025 269/21 |
| 6,170,376 | B1 * | 1/2001 | Strobel | B21D 37/205 76/107.8 |
| 2001/0001937 | A1 * | 5/2001 | Benes | B26F 1/42 83/531 |
| 2003/0000354 | A1 * | 1/2003 | Workman | B26F 1/44 83/13 |
| 2004/0255741 | A1 * | 12/2004 | Deng | B23P 15/406 83/13 |
| 2005/0132861 | A1 * | 6/2005 | Deng | B26F 1/44 83/684 |
| 2013/0014621 | A1 * | 1/2013 | Corcoran | B26F 1/44 83/14 |

OTHER PUBLICATIONS

Cookies [online], Jul. 2012 [retrieved Jan. 18, 2018]. Retrieved from the Internet <http://cookiecuttersearch.com/whatsnew.htm>. (Year: 2012).*

Kitchen Craft, "Five Piece Square Cookie Cutter Set", [online]. Amazon [retrieve Nov. 1, 2019]. Retreived from the Internet: <URL: https://www.amazon.com/Five-Piece-Square-Cookie-Cutter/dp/B004TGU5KQ>. (Year: 2012).*

Fox Run, "Fox Run 3626 6-Piece Star Cookie cutters, 1×3.75×3.75 inches, Metallic", [online]. Amazon [retrieve Nov. 1, 2019]. Retreived from the Internet: <URL:https://www.amazon.com/Fox-Run-3626-6-Piece-Metallic/dp/B001ET5YRU>. (Year: 2008).*

* cited by examiner

MULTI-DIE CUT WITH COMMON AXIS

CLAIM OF PRIORITY

This application claims the benefit priority to U.S. Provisional Application No. 61/750,064, filed on Jan. 8, 2013, and entitled MULTI-DIE CUT WITH COMMON AXIS, which is incorporated herein by reference in its entirety.

BACKGROUND

Steel-rule dies can be used to cut sheet metal, plastics, wood, cork, felt, fabrics, paperboard, and so forth. A hardened steel strip, referred to as a steel rule, is generally used as a cutting surface for such dies.

SUMMARY

A die includes a blade having an edge defining a shape for patterning a sheet of material. The die also includes a cushion surrounding the blade, where the blade edge is positioned within the cushion. The die also includes a support for holding the cutting blade in position and supporting the cushion. The die is configured to be at least partially surrounded by another die.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DRAWINGS

The Detailed Description is described with reference to the accompanying figures. The use of the same reference numbers in different instances in the description and the figures may indicate similar or identical items.

DETAILED DESCRIPTION

Overview

Figure 1A:
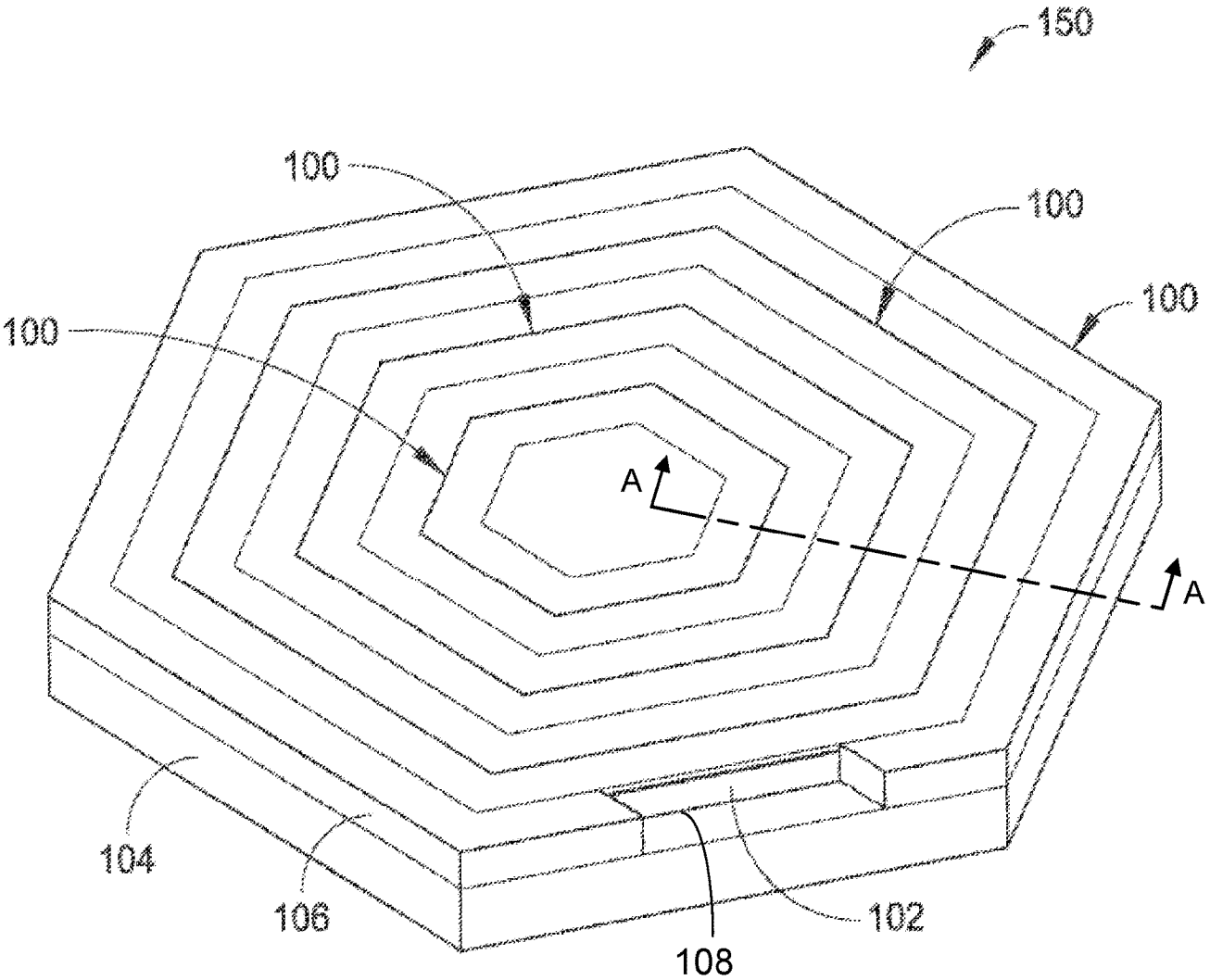
FIG. 1A is a partial isometric view of a die assembly including multiple dies for die patterning sheets of material in accordance with an example implementation of the present disclosure.

Dies, such as steel-rule dies, are used for cutting and shaping sheets of materials in various patterns for education, stationery, scrapbooking, and quilting, among other things. Typically, these dies have a steel-rule blade attached to a wooden support. A layer of a cushioning material, such as foam, is generally applied to the support around the blade and used to prevent the blade from being exposed when the die is not in use, such as when positioning material on the die, and when storing or transporting the die.

A tool for patterning sheets of material is described that includes a die assembly having two or more dies, each die including a blade for patterning the material and cushioning material around the blade. The blade and the cushioning material are held in place by a support. The die is configured to be at least partially surrounded by another die.

Example Implementations

A tool comprising a die assembly 150 is described that includes two or more dies 100, each die 100 including a blade 102 held in position by a support 104 and surrounded by a cushion 106. Each die 100 can be implemented as a die board/steel-rule die for die patterning (cutting and/or shaping) one or more sheets of material, such as sheets of paper or paper-like material. For example, a die 100 may be used to pattern sheets of substances made from wood pulp, rags, straw, and other fibrous materials, such as materials used for writing, printing, wrapping, and the like. A die 100 may also be used with other materials including, but not necessarily limited to: plastic, vinyl, cloth, and ceramic substrates. The materials may include printed patterns, images, and the like. Further, the materials may include multiple layers of one or more types of materials, including adhesive layers, silicone/release coating layers, film liners, and the like. However, these materials are provided by way of example only and are not meant to be restrictive of the present disclosure. Thus, other materials may be used with tools in accordance with the present disclosure.

Each die 100 includes one or more blades 102, each blade 102 having an edge defining a shape for patterning a sheet of material. A blade 102 may be a steel-rule blade, such as a sharpened steel blade that is bent and formed to a pattern for die cutting. While a blade 102 may be capable of cutting through sheets of material, it should be noted that a die 100 is not necessarily configured to perform a full cutting operation in all instances. For example, a blade 102 may be designed to impart fold lines, scores, and/or perforations in materials. Additionally, a blade 102 may be configured to partially cut through a material (e.g., cutting through a top layer of a material when forming adhesive stickers or decals). In some implementations, the tool may also comprise a press or a roller die machine. For example, in operation, a die 100 and material to be patterned may be positioned in a press or a roller die machine, and the final shape may be formed by pressing the material into a blade 102. The blade 102 is held in position with a support 104, which may be formed using high density plywood, steel braces, or the like. Support 104 may be constructed such that the blade 102 will retain its shape during operation, storage, and/or transport. For example, as shown in FIG. 1, a blade 102 may be retained in a channel 108, which may be formed in a piece of high density plywood using a laser cutting process.

Figure 3:
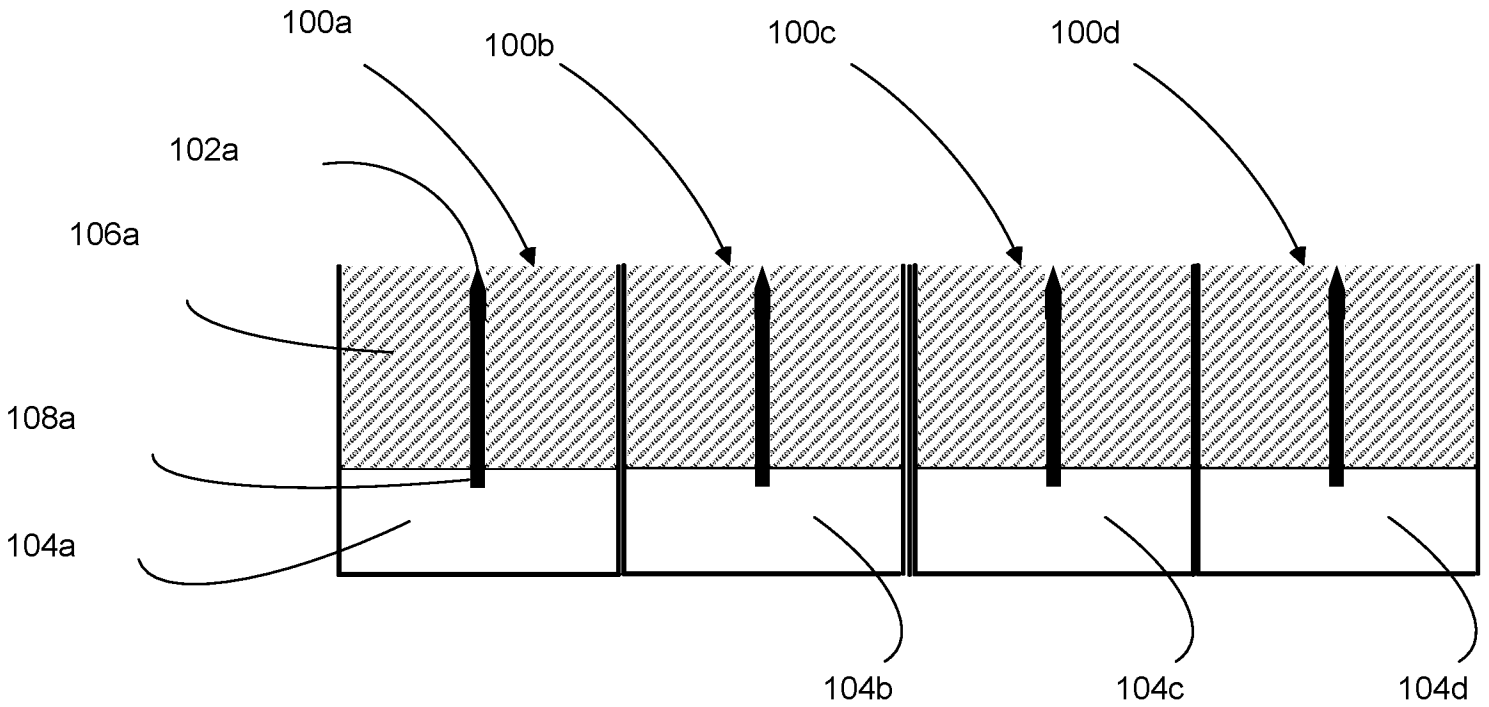
FIG. 3 is an enlarged, cross-sectional view of the exemplary die elements 100*a*, 100*b*, 100*c*, and 100*d* shown in FIG. 1B.

With reference now to FIG. 3, a cross-sectional view of the assembled exemplary die elements 100*a*, 100*b*, 100*c*, and 100*d* taken along the line A-A in FIG. 1A is provided. As discussed above, each of the respective die elements (100*a*, 100*b*, 100*c*, and 100*d*) preferably includes a cushion layer 106*a* which surrounds a blade 102*a*. Each blade 102*a* is preferably secured in a channel 108 within each respective support layer 104*a*. As discussed in detail above, each die element (100*a*, 100*b*, 100*c*, and 100*d*) preferably includes a separate support ((104*a*, 104*b*, 104*c*, and 104*d*).

The support 104 is also configured to support a cushion 106. The cushion 106 may be formed from a reversibly deformable material, such as a foam material, a rubber material, a foam rubber material, and/or other materials having reversibly deformable structural properties. However, these materials are provided by way of example only and are not meant to be restrictive of the present disclosure. Thus, other cushion materials, such as plastic materials and so forth, can be used. The cushion 106 is configured to surround the blade 102 and support the material placed onto the die 100. For example, the cushion 106 may have a generally planar top surface side (i.e., a side opposite the support 104) that extends up to or beyond the edge of the blade 102. When patterning a material (e.g., using a press or a roller die machine), the material may be pressed into a blade 102 by laying the material across the top surface side of the cushion 106 and pressing down on the material, deforming the cushion 106 and exposing the material to the blade 102. The cushion 106 can define one or more apertures and/or other features providing a registration mark for positioning a sheet of material with respect to the blade 102, such as a geometrical shape indicating, for example, the center of a shape formed by the blade 102.

In embodiments of the disclosure, one or more of the dies 100 can be configured to be at least partially surrounded by another die 100. For example, multiple dies 100 can be inserted into one another along a common axis 108. In this manner, multiple dies 100 can form a die assembly 150. The die assembly 150 can be used to pattern material and form nested shapes one inside another. For example, the die assembly 150 can be used to form nested hexagons cut from a sheet of material, where each hexagon is nested in another hexagon (except for the outermost hexagon). However, hexagon shapes are provided by way of example only and are not meant to be restrictive of the present disclosure. Thus, in other embodiments, various shapes can be used including, but not necessarily limited to: triangles, rectangles (e.g., squares), pentagons, circles, stars, and so forth. Further, different shapes can be nested within one another. For example, a circular shape can be formed within a square shape. It should also be noted that while the accompanying figures illustrate each die 100 inserted into another die including a blade 102, spacers having the same general shape as a die 100 can be used to alter the number of separate shapes created by the cutting action of the blades 102 and/or to alter the width of a shape cut using a die assembly 150.

Figure 1B:
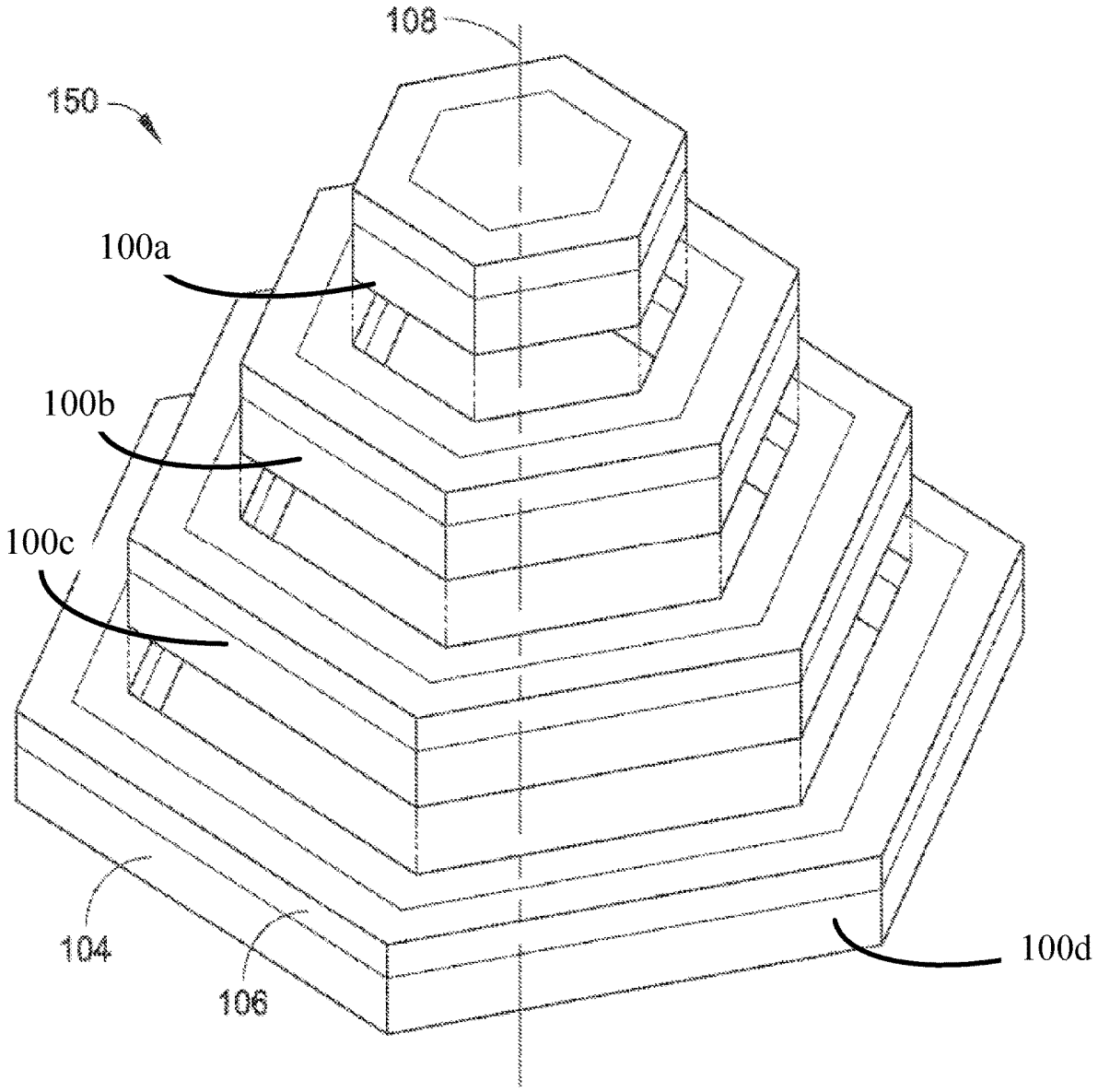
FIG. 1B is an exploded isometric view of the die assembly illustrated in FIG. 1A.
Figure 2:
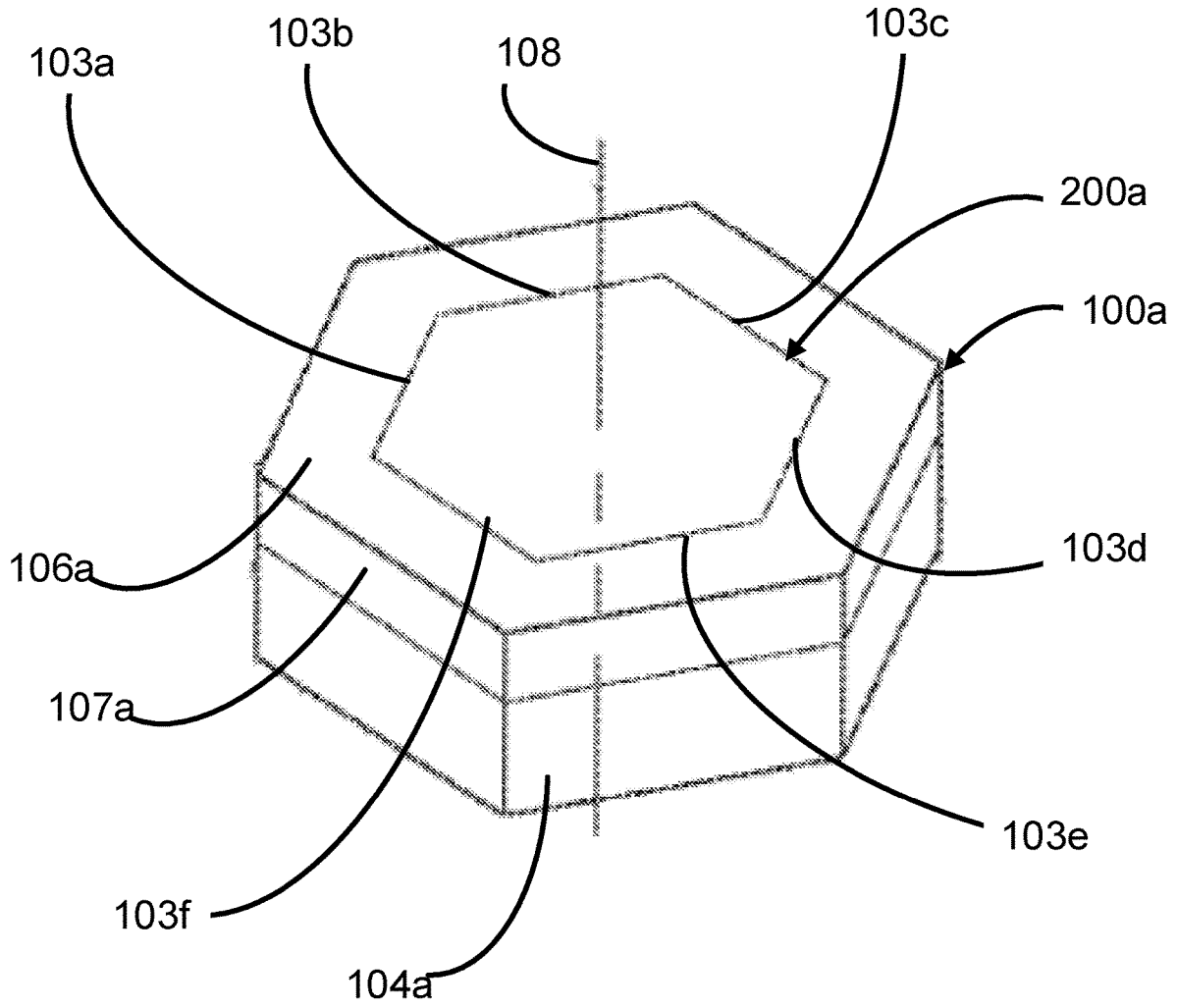
FIG. 2 is an enlarged view of an exemplary die element 100*a* of FIG. 1B.

With reference to FIG. 1B, the nesting of exemplary die elements 100*a*, 100*b*, 100*c*, and 100*d* is shown. With reference to FIG. 2, an enlarged view of exemplary die element 100*a* of FIG. 1B is shown to illustrate the detailed features of each die element 100*a*, 100*b*, 100*c*, and 100*d*.
around the upper exterior surface of the die element 100*a* so that the outer wall 107*a* of the cushion 106*a* forms the outer most portion of the individual die element 100*a* along with the support 104*a*. As further shown, the support element 104*a* is unique to the individual blade element 200*a* and individual die element 100*a*. In this way, as shown in FIG. 1B, each individual die 100*a-d* has its own attached, independent support 104. For exemplary die 100*a*, this is also shown in FIG. 2 as 104*a*.

As shown in FIG. 2, exemplary die element 100*a* is centered around common axis 108. As further shown, the exemplary die element 100*a* includes a blade element 200*a* which is formed from a number of joined sides 103*a*, 103*b*, 103*c*, 103*d*, 103*e*, and 103*f* which together form a given shape. As further shown in FIG. 2, the die element 100*a* further includes a cushion 106*a* and a support element 104*a*. As shown, the cushion 106*a* extends fully around the upper exterior surface of the die element 100*a* so that the outer surface 107*a* of the cushion 106*a* forms the outer most portion of the individual die element 100*a* along with the support 104*a*. As further shown, the support element 104*a* is unique to the individual blade element 200*a* and individual die element 100*a*. In this way, as shown in FIG. 1B, each individual die 100*a-d* has its own attached, independent support 104. For exemplary die 100*a*, this is also shown in FIG. 2 as 104*a*.

CONCLUSION

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A die assembly comprising:

a first die having an outer surface, wherein the first die comprises:
- a first blade having an edge defining a first shape for patterning a sheet of material;
- a first foam layer surrounding the first blade; and
- a first support for holding the first blade in position and supporting the first foam layer;
- wherein the first die has a first perimeter;
- wherein the first foam layer extends around the first perimeter of the first die; wherein the first foam layer comprises foam material which is reversibly deformable between an uncompressed state and a compressed state;
- wherein the first foam layer comprises a planar top surface having a height which meets or exceeds the height of the first blade when the first foam layer is in an uncompressed state;

a second die having an outer surface, wherein the second die comprises:
- a second blade defining a second shape for patterning a sheet of material;
- a second foam layer surrounding the second blade; and
- a second support for holding the second blade in position and supporting the second foam layer;

wherein the second die has a second perimeter; further wherein the second perimeter of the second die is greater than the first perimeter of the first die; wherein the second foam layer extends around the second perimeter of the second die;

wherein, the second support is independent from the first support; further wherein the second support does not provide support to the first blade; wherein the second foam layer comprises foam material which is reversibly deformable between an uncompressed state and a compressed state; wherein the second foam layer comprises a planar top surface having a height which meets or exceeds the height of the second blade when the second foam layer is in an uncompressed state; and a third die having an outer surface, wherein the third die comprises:
- a third blade defining a third shape for patterning a sheet of material;
- a third foam layer surrounding the third blade; and
- a third support for holding the third blade in position and supporting the third foam layer;
- wherein the third die has a third perimeter;
- further wherein the third perimeter of the third die is greater than the second perimeter of the second die;
- wherein the third foam layer extends around the third perimeter of the third die;

wherein, the third support is independent from the first support and the second support; further wherein the third support does not provide support to the first blade or the second blade; further wherein the second support does not provide support to the third blade; wherein the third foam layer comprises foam material which is reversibly deformable between an uncompressed state and a compressed state; wherein the third foam layer comprises a planar top surface having a height which meets or exceeds the height of the third blade when the third foam layer is in an uncompressed state;

wherein the first blade, the second blade and the third blade are arranged to make three separate, simultaneous cuts to a given sheet of material.

2. The die assembly of claim 1, wherein the first blade is secured within a first channel formed in the first support.

3. The die assembly of claim 2, wherein the second blade is secured within a second channel formed in the second support.

4. The die assembly of claim 3, wherein the third blade is secured within a third channel formed in the third support.

5. The die assembly of claim 4, wherein the first shape of the first blade comprises five sides extending and centered around a central point.

6. The die assembly of claim 5, wherein the second shape of the second blade comprises five sides extending and centered around the central point.

7. The die assembly of claim 6, wherein the third shape of the third blade comprises five sides extending and centered around the central point.

* * * * *